US012139318B2

(12) United States Patent
Dalla Mora

(10) Patent No.: US 12,139,318 B2
(45) Date of Patent: Nov. 12, 2024

(54) CONTAINER FOR LIQUID FOOD SUBSTANCES, IN PARTICULAR ALCOHOLIC BEVERAGES

(71) Applicant: ILLVA SARONNO S.p.A, Saronno (IT)

(72) Inventor: Paolo Dalla Mora, Milan (IT)

(73) Assignee: ILLVA SARONNO S.p.A., Saronno (IT)

( * ) Notice: Subject to any disclaimer, the term of this patent is extended or adjusted under 35 U.S.C. 154(b) by 378 days.

(21) Appl. No.: 17/601,287

(22) PCT Filed: Mar. 27, 2020

(86) PCT No.: PCT/EP2020/058778
§ 371 (c)(1),
(2) Date: Oct. 4, 2021

(87) PCT Pub. No.: WO2020/201121
PCT Pub. Date: Oct. 8, 2020

(65) Prior Publication Data

US 2022/0204236 A1 Jun. 30, 2022

(30) Foreign Application Priority Data

Apr. 4, 2019 (IT) ..... 102019000005122

(51) Int. Cl.
*B65D 51/28* (2006.01)
*B65D 1/02* (2006.01)
(Continued)

(52) U.S. Cl.
CPC ..... *B65D 77/0453* (2013.01); *B65D 1/0246* (2013.01); *B65D 23/0885* (2013.01)

(58) Field of Classification Search
CPC ..... B65D 1/023; B65D 1/0246; B65D 1/18; B65D 1/20; B65D 1/44; B65D 23/0885;
(Continued)

(56) References Cited

U.S. PATENT DOCUMENTS 3,197,066 A * 7/1965 Denzler ..... B65D 81/3227 222/129
5,111,937 A * 5/1992 Schutz ..... B65D 77/0466 206/592

(Continued)

FOREIGN PATENT DOCUMENTS

DE 10 2006 012 025 A1 9/2007
DE 2198465 * 9/2007

(Continued)

OTHER PUBLICATIONS

Italian Search Report Corresponding to 201900005122 mailed Sep. 23, 2019.

(Continued)

*Primary Examiner* — King M Chu
(74) *Attorney, Agent, or Firm* — Finch & Maloney PLLC

(57) ABSTRACT

A container for liquid food substances which comprises a first containing element (1) having a first body (2) delimiting a cavity (4), and a closing part (5) for closing the cavity (4). The first body and the closing part (5) are made of a metal material. A second containing element (8, 108) made of plastic material for foodstuff, which comprises a first part (9, 109) suitable to be completely housed in the first containing element (1). A neck (10, 110) departing from an upper wall (9A, 109A) of the second containing element (8, 108), suitable to cross the through opening (6) of the closing part and provided with an outflow part (11, 111) projecting outside the closing part suitable to allow the food substance to flow out of the container. The outflow part (11, 111)

(Continued)

Figure 1:
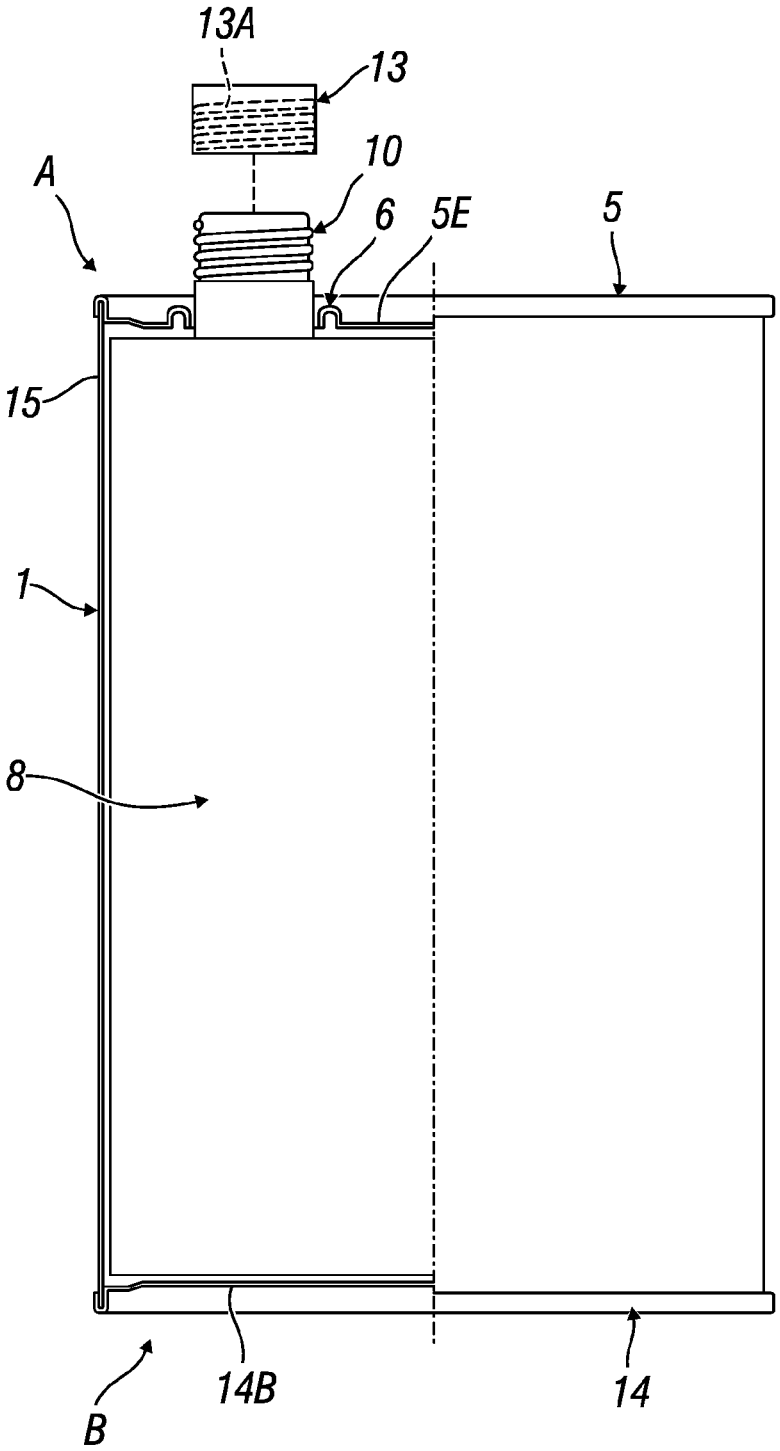

having mechanism (12, 112) for removably connecting a cap (13) for tightly sealing the container.

17 Claims, 9 Drawing Sheets

(51) Int. Cl.
*B65D 23/08* (2006.01)
*B65D 77/04* (2006.01)

(58) Field of Classification Search
CPC .... B65D 41/04; B65D 25/16; B65D 77/0493; B65D 77/0426; B65D 77/0486; B65D 77/0453; B65D 81/3818; B65D 81/3216; B65D 7/06; B65D 43/0218
USPC ..... 220/23.87, 288, 212, 737; 222/572
See application file for complete search history.

(56) References Cited

U.S. PATENT DOCUMENTS

2004/0140323 A1* 7/2004 Ricotti ..... B65D 85/76 222/134
2006/0280846 A1* 12/2006 Anelli ..... B65D 17/4011 426/122
2008/0061065 A1* 3/2008 Aronson ..... B65D 1/36 206/514

FOREIGN PATENT DOCUMENTS

DE 20 2011 106 497 U1 1/2012
EP 2 942 306 A1 11/2015
FR 2 198 465 3/1974
FR 202011106497 * 3/1974

OTHER PUBLICATIONS

International Search Report Corresponding to PCT/EP2020/058778 mailed Aug. 4, 2020.
Written Opinion Corresponding to PCT/EP2020/058778 mailed Aug. 4, 2020.

* cited by examiner

CONTAINER FOR LIQUID FOOD SUBSTANCES, IN PARTICULAR ALCOHOLIC BEVERAGES

Object of the present invention is a container for liquid food substances, in particular alcoholic beverages according to the pre-characterizing part of the main claim.

Metal containers of the type indicated above have been known for quite some time and are usually used for containing olive oil, since they have excellent light shield, resistance and reliability features and are simple to manufacture and have a relatively low cost.

These containers of the type used for olive oil, however, have not found use in the field of alcoholic beverages because it has been experimentally verified that inside these containers an alcoholic beverage generates rust, which negatively affects the taste and flavor of the alcoholic beverage itself, when it is consumed. In particular, it has been verified that this rust preferably forms in correspondence with the parts of the metal container that are constrained together by seaming or by means of a cold plastic deformation of these parts. Furthermore, these oil containers which are currently on the market are not suitable to contain liquids with a high water percentage, such as carbonated and non-carbonated beverages, alcohol and spirits because the internal coatings of the known containers corrode. It has been experimentally verified that an oxidation reaction and deterioration of the taste of the alcoholic beverage contained in the containers occur even coating the inside of the containers with coating for alimentary use.

To overcome these drawbacks, it is known to make containers for alcoholic beverages in metal alloys with high anti-corrosion characteristics, for example aluminum, and/or steel, which however provide connecting the various parts of the container through welds. However, these processes are relatively complicated and/or expensive.

The object of the present invention is to provide a metal container alternative to the known ones which allows to store alcoholic drinks without altering the taste and the flavor and which allows to pass the international food certification tests, while having all the advantages of the known metal containers, in particular the advantages of the usual containers for olive oil.

This and other objects are achieved by a container according to the characterizing part of the attached claims.

Figure 2:
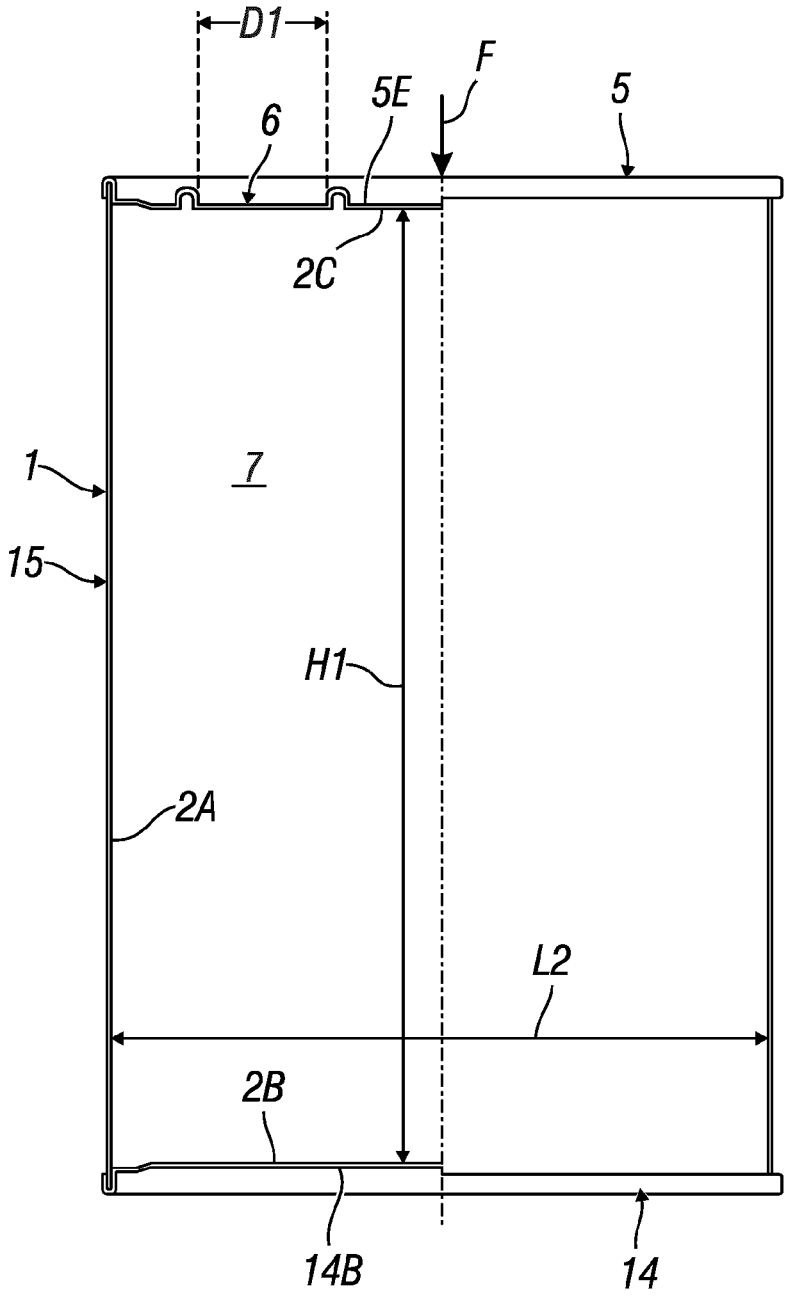
Figure 3:
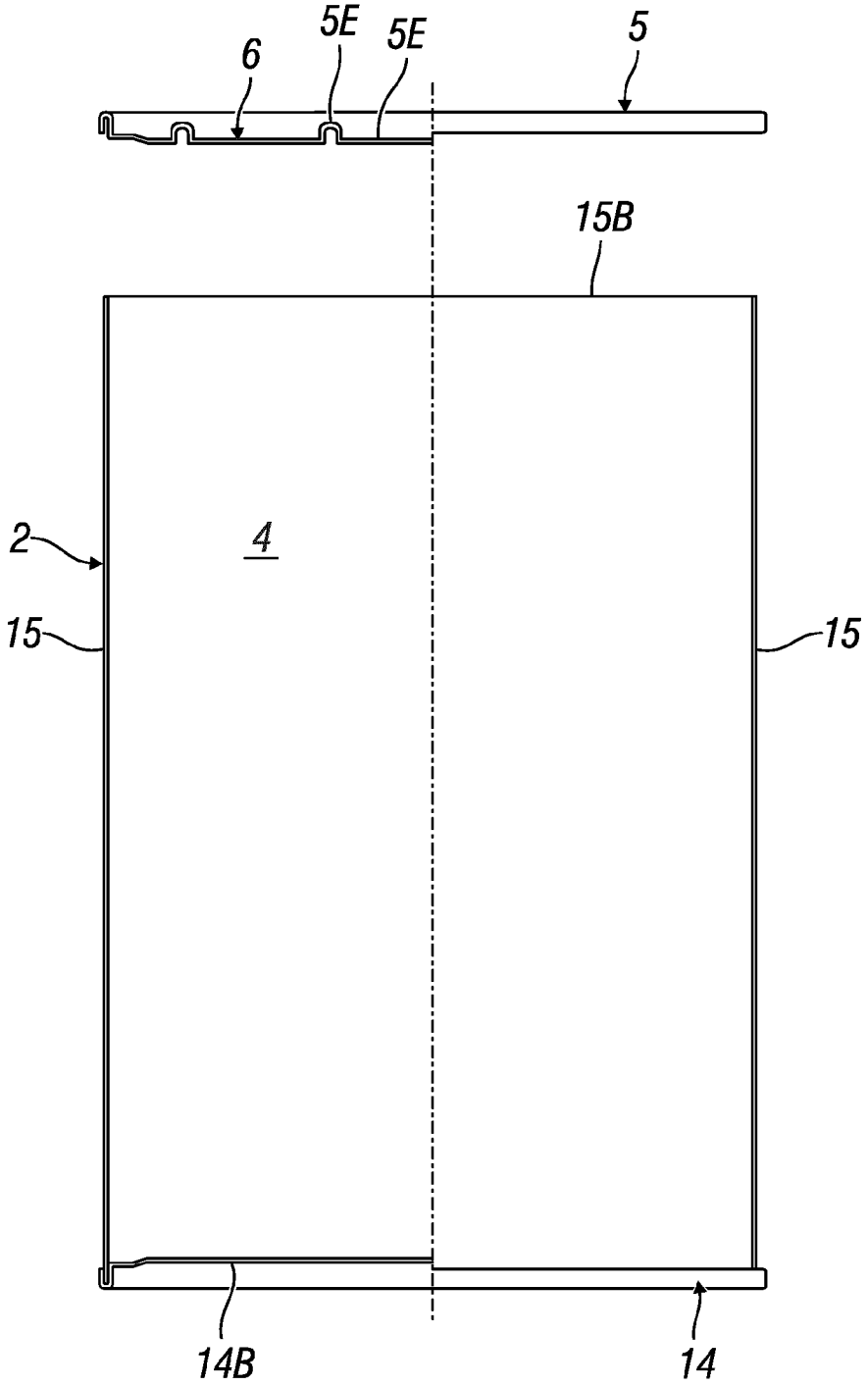
Figure 4:
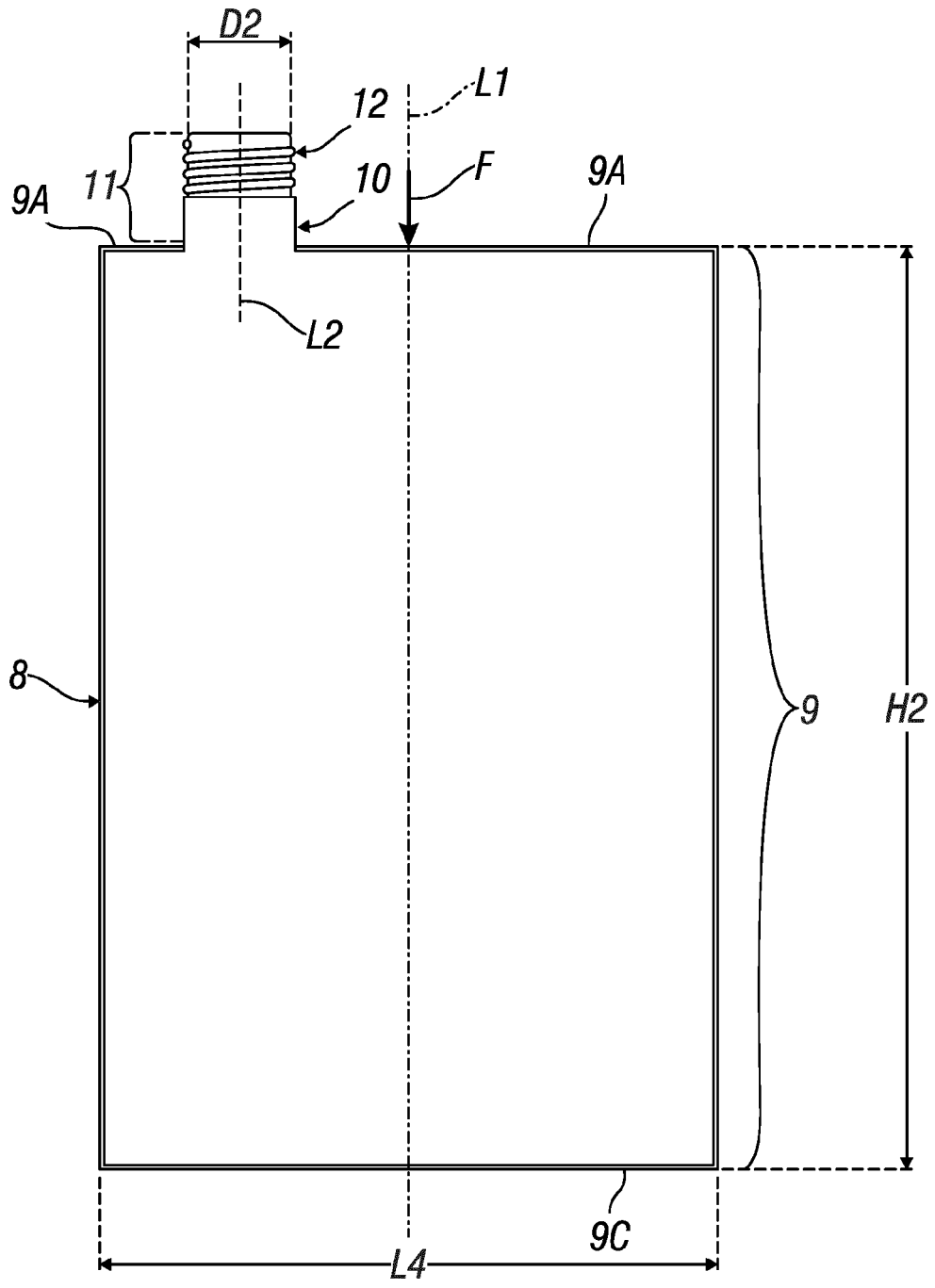
Figure 5:
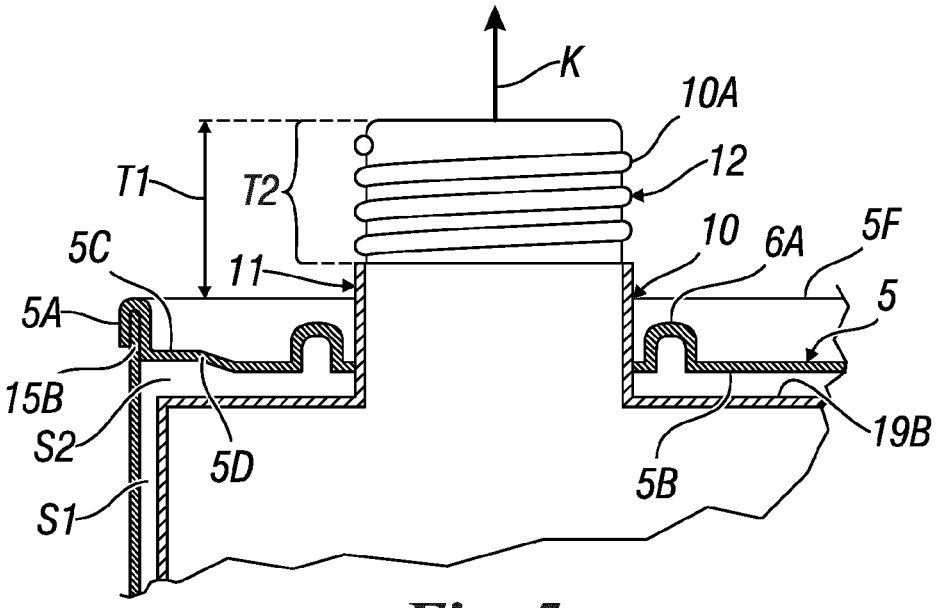
Figure 6:
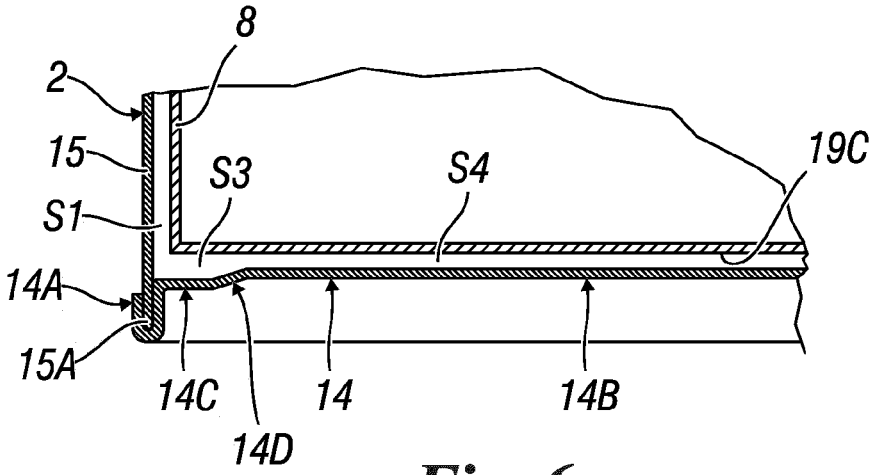
Figure 7:
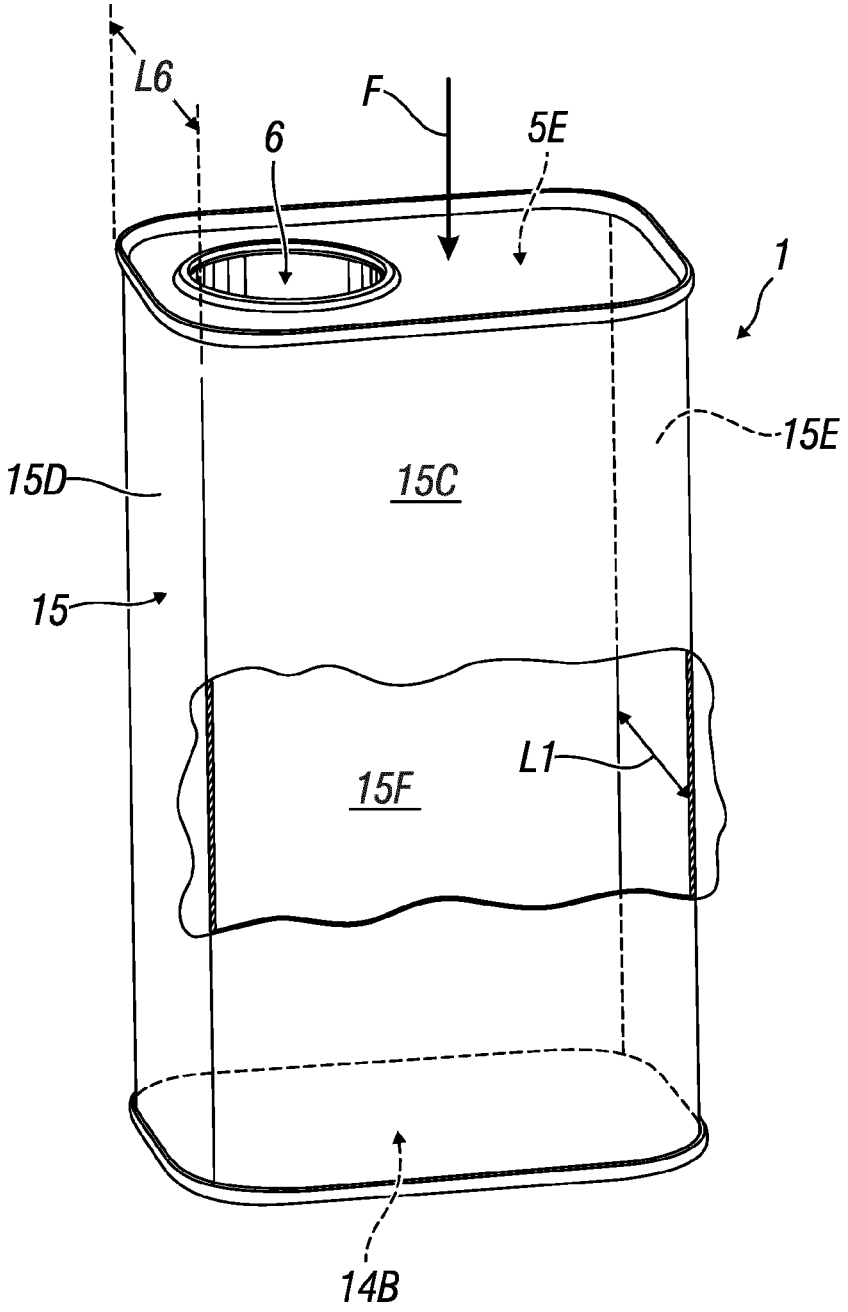
Figure 8:
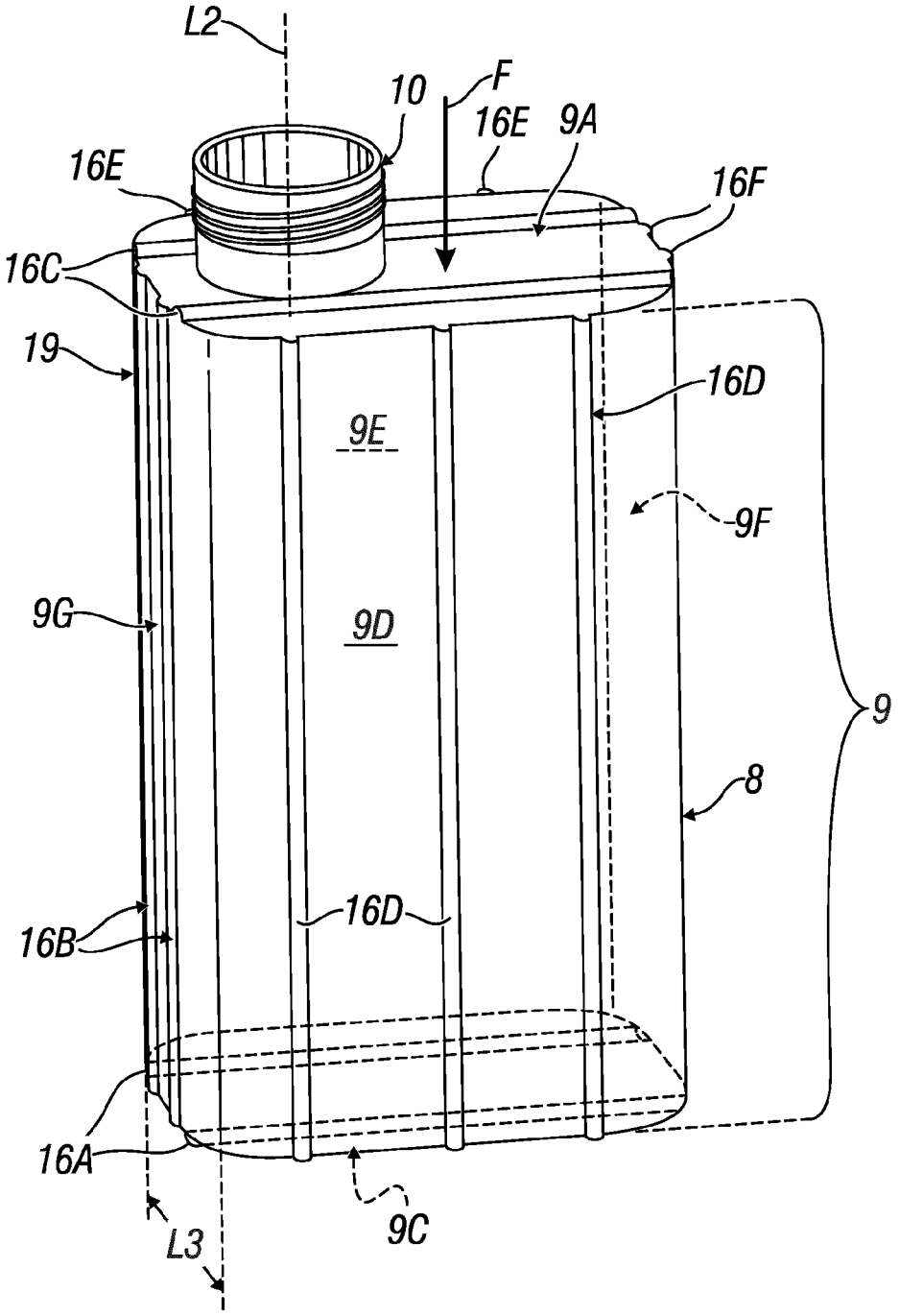
Figure 9:
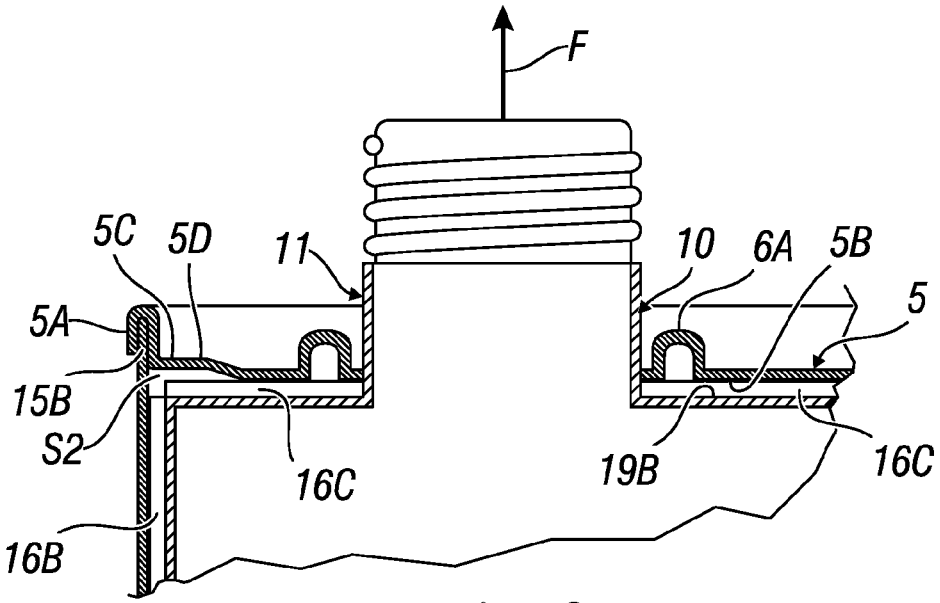
Figure 10:
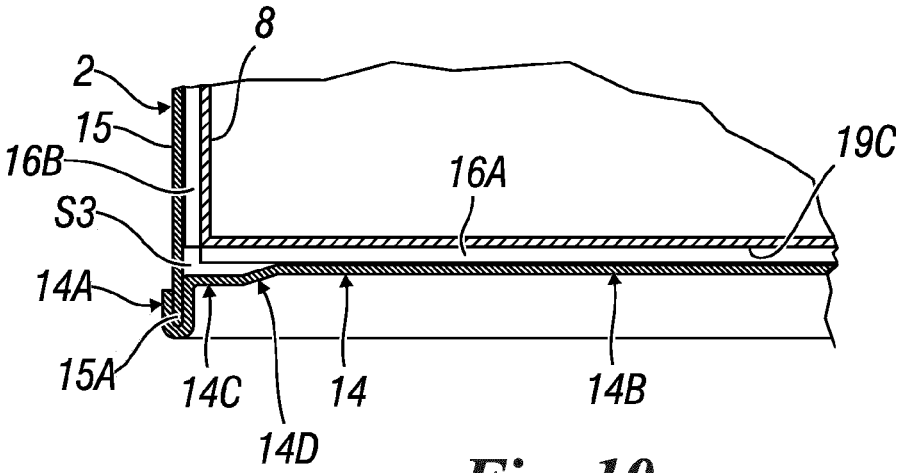
Figure 11:
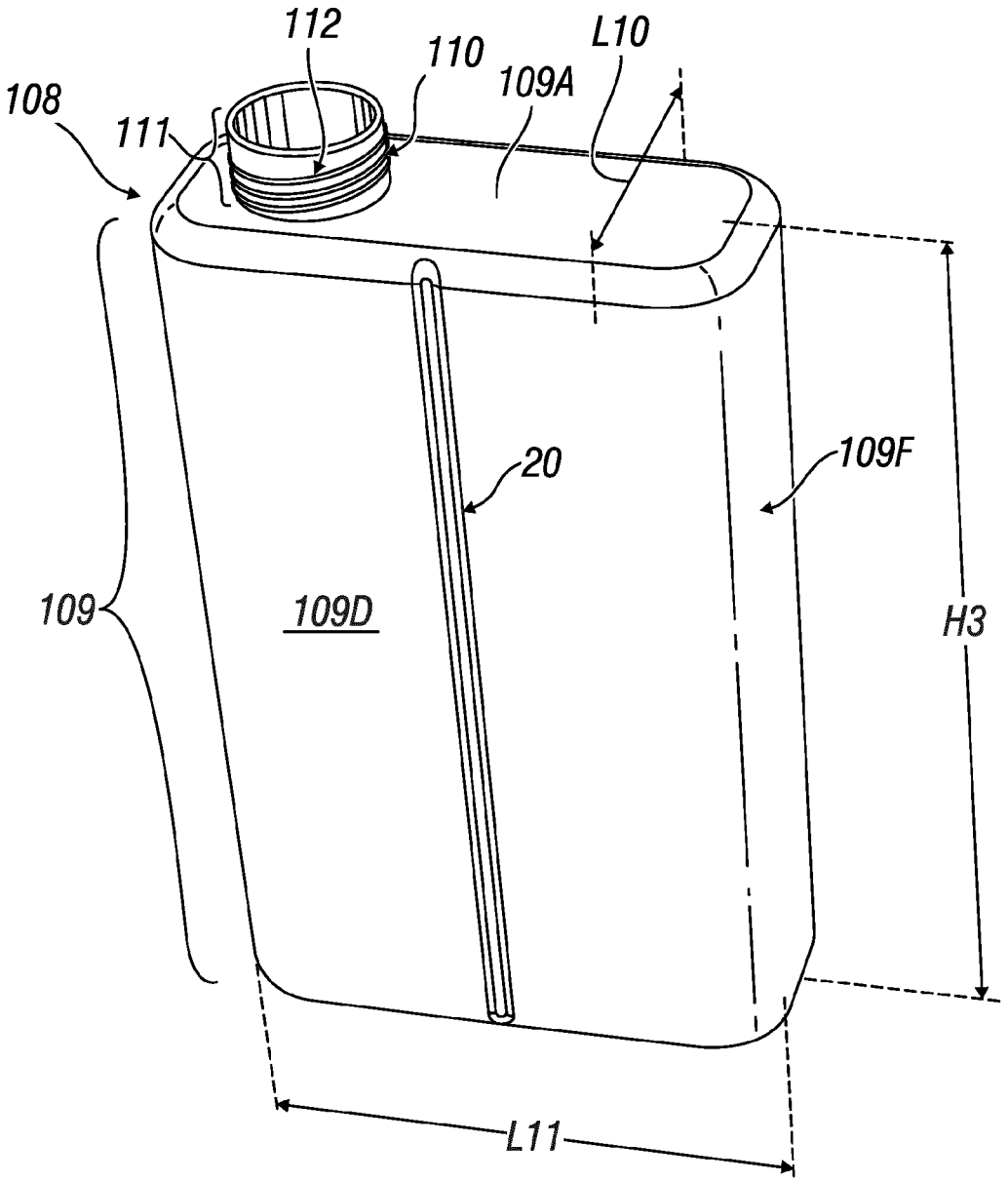

For a better understanding of the present invention there are attached, by way of non-limiting example, the following drawings, wherein:

FIG. 1 shows a schematic, partially sectioned front view of a container according to the invention, FIG. 2 shows a schematic, partially sectioned front view of a first containing element of the container according to the invention, FIG. 3 shows a schematic, partially sectioned front view of the first containing element of FIG. 2 with an upper closing part which is not connected to the lower one, FIG. 4 shows a schematic, partially sectioned front view of a second containing element suitable to be partially introduced in the first element, FIGS. 5 and 6, and 9, 10 show enlarged schematic sectional views of the details indicated by the arrows A and B in FIG. 1, taken according to two different section planes, parallel to each other, FIG. 7 shows a schematic, partially sectioned prospective view of the first containing element of the container according to the invention, FIG. 8 shows a schematic prospective view of the second containing element of the container according to the invention, FIG. 11 shows a schematic prospective view of a second embodiment of the second containing element of the container according to the invention.

With reference to FIGS. 1-10, they show a container for liquid food substances, in particular alcoholic beverages, comprising a first containing element 1 (FIG. 2) made of a metal material, comprising:

- at least one first body 2 (FIG. 3) suitable to delimit a cavity 4, wherein said first body preferably comprises a first part suitable to delimit a side wall and a second part suitable to delimit a bottom wall, wherein said two parts are connected to each other so as to form said first body,
- and a closing part 5 (FIG. 3) for closing said cavity 4, suitable to be connected to said first body and comprising a through opening 6, wherein said first body 2 and said closing part 5 are both made of a metal material and delimit a containing space 7 (FIG. 2).

In this context, metallic material means any material made of one or more metals and/or one/or more metal alloys.

According to the invention, the container also comprises a second containing element 8 (FIG. 4) made of plastic material for foodstuff and comprising a first part 9 suitable to be introduced and completely housed in said first containing element 1, in said containing space 7, and a neck 10 departing from an upper wall 9A (FIG. 4) of said first part 9 of the second containing element 8, suitable to cross the through opening 6 of the closing part 5 of the first containing element 1, and provided with an outflow part 11 (FIG. 4) projecting outside said closing part 5 of the first containing element 1, suitable to allow the food substance to flow out of the container, said outflow part 11 having means 12 (FIG. 4) for removably connecting a cap 13 (FIG. 1) for tightly sealing the container.

According to the invention, both the first 1 and the second 8 containing element are substantially rigid elements.

In this context, the expression "substantially rigid" means that the containing element 1 and/or the containing element 8 does not deform when subjected to the usual forces with which the containers for beverages can be stressed; for example, if subjected to a longitudinally and centrally directed force F (FIGS. 2, 4, 7, 8) equal to 0.1 kg the containing elements 1 and 8 do not deform.

According to a first preferred embodiment of the invention, the container provides the combination of these further features:

a) that above the closing part 5 and projecting from said closing wall 5, the container only has said closing cap 13 and said outflow part 11, of said neck 10, of the second containing element 8, so that the cap always remains visible, b) that the containing space 7 is a closed space which has a single opening consisting of the through opening 6 of the closing part 5, so as to make the implementation of the container easier and to better protect the second plastic container 8, c) that the container only has said outflow part 11 of said neck 10 of said containing element 8 for the entry and outflow of liquid food substances, so as to simplify the shape and the manufacture of said second container, d) that said closing part 5 of said cavity 4 has a substantially flat shape.

According to a second preferred embodiment of the invention, described in greater detail below and with reference to FIG. 11, the container provides the combination of these further features: the second containing element 108 has one or more recessed elements 20 for the outflow of the air contained in the cavity 4 of the first body 2 of the first containing element 1, when the second containing element 108 is introduced into said cavity, and said recessed element 20 extends throughout the entire height of at least one of the side walls 109D of the first part 109 of said second containing element 108.

According to a third preferred embodiment of the invention, the sizes of the first part 9 of the second containing element 8 are substantially the same than the corresponding sizes of the cavity 4 of the first body 2 of the first containing element 1, or said sizes of the first part 9, of said second containing element 8, are smaller in percentage by a value S, with 1%⇐S⇐5% than the corresponding sizes of said cavity 4 of the first body 2 of the first containing element 1.

Preferably, the first part 9 of the second containing element 8 is sized so as to leave at least one little free space S1-S4 FIGS. 5 and 6 and without contact between at least one portion of the outer surfaces of the walls 19A-C (FIG. 4) of the first part 9 of the second containing element 8 and the inner surfaces of the walls 2A-C of the first body 2 of the first containing element 1, so as to make the insertion of said second containing element 8 into the cavity 4 of said first body 2 of the first containing element 1 easier. More particularly, according to a preferred embodiment, the first body 2 (FIG. 3) of the first containing element 1 (FIG. 2) comprises: a lower closing wall 14 and a side part 15 comprising, in the example shown, four side walls 15C-15F (FIG. 7).

The outer edge of the lower closing wall 14 is rigidly constrained to the corresponding lower edge 15A (FIG. 6) of the side part 15, so as to form a single body. Advantageously, the lower wall 14 and the side part 15 are constrained through a cold plastic deformation of respective portions. For this purpose, for example, the lower wall 14 in correspondence with its edge has a folded portion 14A (FIG. 6) having for example a U-shaped cross-section, so that the lower edge 15A of the side part 15 may be introduced into the space delimited by the arms of said U-shaped folded portion and the side wall is steadily constrained to the bottom wall 14 by deforming or tightening said arms of the U-shaped folded portion. Other conventional types of seaming could be used to constrain the lower wall 14 and the side part 15 together; as conventional for the expert in the field, these ones could also be constrained together through other conventional connection methods, for example through welding. It should also be noted that the first body 2 could also be made of a single metal piece, for example by deforming a conventional metal sheet using conventional techniques, in the latter case, the lower wall and the side part are formed by a single continuous metal wall.

The side part 15 is made in a conventional way by tubularly shaping one or more metal sheets which are connected together in a conventional way.

Advantageously, the lower wall 14 has a step 14D (FIG. 6) in correspondence with its edge, so as to create an innermost surface 14B suitable to come into contact with the bottom wall 19C of the second containing element 8 and a peripheral surface 14C at a larger distance from said bottom wall 19C, hence creating peripherally an empty space S3 which makes air outflow easier when the second containing element 8 is introduced into the cavity 4 of the first body 2 of the first containing element 1, thus helping this introduction as well.

Preferably, the closing upper part 5 of the first containing element is constrained to the upper edge 15B (FIGS. 3 and 5) of the side part 15 in a manner similar to that previously described, for the lower wall 14, so as to form a single body. Thus, advantageously, the upper part 5 and the side part 15 are constrained through a cold plastic deformation of the respective portions. For this purpose, the upper closing part 5 in correspondence with its edge has a folded portion 5A having for example a U-shaped cross-section, so that the upper edge 15B of the side wall 15 may be introduced into the space delimited by the arms of said U-shaped folded portion and the side wall is steadily constrained to the upper part 5 by deforming or tightening said arms of the U-shaped folded portion. As for the lower wall 14, other conventional types of seaming could be used to constrain the upper part 5 and the side part 15 together.

It should be noted that, according to a different embodiment, the upper closing part 5 could even not to be permanently constrained to the side part 15, for example the upper edge 15B of the side part 15 could be only forcibly introduced in the U-shaped folded portion 5A of the closing part 5 but without excessively tightening the arms of said U-shaped folded portion, in order to make this connection unstable and not definitive.

Thanks to this solution, when the container is used the closing part 5 is constrained to the side part 15, but when the container must be disposed in the waste the upper part 5 can be detached from the side part 15, and the plastic containing element 8 can be easily removed from the metal containing element 1 and disposed separately. It would be possible for example to act on the neck 10 of the plastic containing element by pushing it upwards (arrow K of FIG. 5) to remove the closing part 5 from the side part 15.

The closing part 5, as well, preferably has a step 5D so as to create an innermost surface 5B (FIG. 5) suitable to come into contact with the upper wall 9A of the second containing element 8 and a peripheral surface 5C at a larger distance from said upper wall 9A, hence creating peripherally a larger-sized empty space S2 which makes air outflow easier.

In correspondence with the through opening 6 the upper wall has advantageously a folded edge 6A (FIG. 5) suitable to strengthen and stiffen the perimeter of said opening 6.

The opening 6 has sizes D1 (FIG. 2) which are slightly higher than those D2 (FIG. 4) of the neck 10 of the second coupling element 8, so that the neck can easily cross the opening 6, namely the diameter D2 of the neck 10 is smaller than the diameter D1 of the opening 6 by a value of between 0.5 mm and 5 mm.

The opening 6 has a size which is many times smaller than that of the second containing element 8 (in particular the opening 6 has a size which is less or equal to 50% of the width L4 (FIG. 4) of the larger side walls 19D, 19E (FIG. 8) of the second containing element), so that the latter, according to the invention, can in no way be introduced into the first containing element 1 by crossing the opening 6 and/or cannot be implemented by inserting a component in said opening suitable to implement the second containing element.

Moreover, advantageously, the opening 6 is circular and has a diameter D1 which is about (+/−10%) 50% of the width L6 (FIG. 7) of the narrower face 15D, 15E of the container, in this way a relatively large neck 10, which makes the beverage outflow in a better and faster way from the container, can be introduced into the opening 6.

The first containing element 1 has for example a cylindrical shape with a cross-section which is circular or elliptical or rectangular with rounded corners (as represented in FIG. 7).

More particularly, preferably the first containing element 1, when assembled (FIG. 7) has a three-dimensional body, comprising a lower substantially flat wall 14B and an upper substantially flat wall 5E (FIGS. 2 and 3), parallel to each other and connected to each other by a side part 15, which in the example in FIG. 7 comprises a front wall 15C and a rear wall 15F, parallel to each other, and two walls 15D 15E, perpendicular to the latter, wherein all these side walls are perpendicular to the two bottom and upper walls. The inner surfaces of the two lower 14 and upper 5 walls are spaced apart by a stretch H1 (FIG. 2) while the inner surfaces of the pairs of side walls 15C, 15F and 15D, 15E, parallel to each other, are spaced apart by a stretch L1 (FIG. 7) and L2 (FIG. 2), respectively.

The first part 9 of the second containing element 8 has a shape which is substantially identical to that delimited by the inner surfaces of the side parts 15 and of the upper 5 and lower 14 walls of the first containing element delimiting the space S suitable to house said first part 9 of the second containing element 8. Said first part 9 of the containing element has, therefore, a three-dimensional body, comprising a lower substantially flat wall 9C (FIG. 4) and an upper substantially flat wall 9A (FIG. 4) parallel to each other and connected to each other by a side part 19 which in the example in FIG. 8 comprises a front wall 9D (FIG. 8) and a rear wall 9E, parallel to each other, and two walls 9F 9G, perpendicular to the latter, wherein all these side walls are perpendicular to the two bottom 9C and upper 9A walls. The outer surfaces of the two lower 9C and upper 9B walls are spaced apart by a stretch H2 (FIG. 4) while the outer surfaces of the pairs of side walls 9D, 9E are 9F, 9G, parallel to each other are spaced apart by a stretch L3 (FIG. 8) and L4 (FIG. 4), respectively.

Preferably, so as to help the introduction of the second coupling element 2 into the cavity 4 of the first body 2 of the first containing element 1, the sizes of the first part 9 of the second containing element 8, namely the length of the stretches L3 (FIG. 8), L4, H2 (FIG. 4), are slightly smaller than the corresponding sizes of the cavity 4 of the first body 2 of the first containing element 1, namely the length of the stretches L1 (FIG. 7) L2, H2 (FIG. 2), the expression "slightly smaller" meaning that said minor sizes are smaller by a value K, with 0.5 mm⇐K⇐20 mm and more preferably 1 mm⇐K⇐5 mm. For example: L4=(L2−K), L3=(L1−K) and H2=(H1−K) with 0.5 mm⇐K⇐20 mm and more preferably 1 mm⇐K⇐5 mm.

Thanks to this sizing, at least one free space S1-S4 (FIG. 5, 6) without contact is created between at least one portion of the outer surfaces of the walls 9A-G of the first part 9 of the second containing element 8 and the inner surfaces of the walls 14B, 15C-F of the first body 2 of the first containing element 1 that delimit the space 7 in which said first part 9 of the second connecting element is housed, so as to help the introduction of said first part 9 of the second containing element 8 into said cavity 4 of the first containing element 2, when the container has to be assembled, since said free spaces allow the air contained in said cavity 4 to outflow.

To ensure that the second coupling element 2 is introduced into the cavity 4 of the first body 2 of the first containing element 1, in a stable manner and so as to avoid even minimal accidental displacements, the outer surfaces of the side walls 9D-G of the second containing element 8, and preferably also those of the bottom upper and lower walls 9A and 9C, have a plurality of raised elements or reliefs 16A-F (FIG. 8), suitable to come into contact with the surfaces which delimit the cavity 4 (as schematically shown in FIGS. 9 and 10 where sections of the raised elements 16A-C can be seen). Said raised elements 16A-F can extend throughout the entire length of the walls 19D-G and 19B-C (as shown in FIG. 8), or even only throughout a portion of this length, and can have an elongated shape (as shown in FIG. 8) or even another shape suitable to the purpose, for example a hemispherical shape. It should be noted that by limiting the contacting surfaces between the plastic coupling element 8 and the cavity 4 in which it must be introduced, said raised elements 16 reduce the friction between said surfaces thus favoring this introduction.

As shown in the figures, the neck 10 is out of axis compared to a central symmetry axis L1 (FIGS. 8 and 4) of the second containing element 2 and hence of the first containing element 1, and the axis L2 of the neck 10 is close to one of the smaller side walls 9G (FIG. 8) of the containing element 8, so as to help emptying of the container.

The second containing element 8 is made of a plastic material suitable to contain foodstuff and in particular alcoholic beverages, for example spirits such us gin, vodka, whiskey, of a conventional type for the expert in the field, and of the type suitable not to alter the taste and the flavour of the beverage.

The container also comprises a cap 13 (FIG. 1), of the conventional type, internally having a thread 13A suitable to engage the connecting means 12 provided on the neck 10, for example through a corresponding thread 10A. The cap could also be of the type different from the one shown and have other usual means for tightly sealing it to the neck 10 (for example lever coupling means).

The neck 10 shows an outflow part 11 (FIG. 5) projecting outside the first containing element 1, suitable to allow the food substance to flow out of the container, and having the means 12 for removably connecting the cap 13 for tightly sealing the container. Said outflow part 11 is sized so as to project by a stretch T1 (FIG. 5) from the upper free edge 5F (FIG. 5) of the upper bottom wall 5 of the first containing element 1, thus helping to pour the beverage from the container; the stretch T has for example a length of between 0.5 cm and 4 cm, more preferably between 1.5 cm and 3 cm. Preferably the thread 10A projects by a stretch T2 which is provided completely above the upper free edge 5F of the upper bottom edge 5 of the first containing element 1 so that also caps 13 of large dimensions (thus easier to operate) which can therefore also have larger or equal dimensions than the length L6 (FIG. 7) of the smaller side walls 15D 15E of the first containing element can be connected to the container.

FIG. 11 shows a second embodiment of the second plastic containing element, the parts shared by the previous embodiment will not be further described and will be indicated in FIG. 11 with the same numbering used for the previous embodiment, but increased by 100.

The main difference between said second containing element 108 and the containing element 8 previously described lies in that it has one or more recessed elements or grooves 20 (in the example in FIG. 11 only one groove 20 is shown) for the outflow of the air contained in the cavity 4 of the first body 2 of the first containing element 1, when the second containing element is introduced into said cavity. The recessed element 20 extends throughout the entire height of the wall 109D in which said groove is present.

The sizes of the first part 109 of said second coupling element 108 are substantially the same than the corresponding sizes of the cavity 4 of the first body 2 of the first containing element 1, or are slightly smaller than the corresponding sizes of the cavity 4, the expression "slightly smaller" meaning that said smaller sizes are smaller in percentage by a value S, with 1%⇐S⇐5%.

Preferably the second containing elements 8, 108, are made of a plastic material certified according to the various world standards for the use of foodstuff and beverages, namely alcoholic beverages, they are substantially rigid, and have a wall thickness of between 0.3 mm and 0.8 mm and more preferably between 0.4 mm and 0.6 mm and even more preferably of about 0.5 mm.

The method for manufacturing the container described so far provides to manufacture separately:

the components of the first containing element 1, and to assemble together, for example through a cold plastic deformation of respective portions or through seaming, the bottom wall 14 and the side wall 15, so as to make the body 2 suitable to delimit the cavity 4, that at this stage is thus completely open on the upper side, and the second containing element 8, 108 made of a plastic material, for example through moulding, according to techniques of a conventional type for the expert in the field.

The method hence provides:

to introduce the body 9, 109 of the second containing element 8, 108 into the cavity 4 of the first containing element 1;

and thereafter to connect the closing part 5 of the cavity 4 of the first containing element 1 with the upper free edge 15B of said cavity 4, providing that the neck 10, 110 of the second containing element 8, 108 crosses a through opening 6 of said closing part 5.

Thanks to the container according to the invention, it is possible to make containers comprising an outer metal containing element, that can be also made of a metal or a "poor" metal alloy of the type having low anti-corrosion characteristics (compared in particular to other metal alloys such as steels, for example). However, the container according to the invention has all the advantages of the containers made of more precious metals, it being suitable, for example, to effectively protect the beverage from both the effects deriving from light and from impacts that could for example pierce the container itself. The presence of the second containing element made of plastic for foodstuff also ensures optimal preservation of the beverage without any significant alteration of its taste and/or flavor.

Finally, it is stated again that the embodiments shown so far are given purely by way of example that a number of variations are possible, all of which falling within the same inventive scope, similarly for example the shape and sizes of the first and second containing element could be other than those shown so far.

The invention claimed is:

1. A container for a liquid food substance comprising:

a first containing element made of a metal material, comprising: at least one first body suitable to delimit a cavity, and a closing part for closing said cavity, suitable to be connected to said first body and comprising a through opening, wherein said first body and said closing part are both made of a metal material, and said first body and said closing part delimit a containing space;

a second containing element made of plastic material for foodstuff, comprising: a first part suitable to be introduced and completely housed in said first containing element, in said containing space and said cavity, and a neck departing from an upper wall of said first part of the second containing element suitable to cross the through opening of the closing part of the first containing element, and provided with an outflow part projecting outside said closing part of the first containing element, suitable to allow the food substance to flow out of the container; said outflow part having means for removably connecting a cap for tightly sealing the container;

both the first and the second containing element are substantially rigid and non-deformable elements having the same three-dimensional shape;

a) above the closing part and projecting from said closing part, the container only has said closing cap and said outflow part of said neck of the second containing element so that the cap is always visible, b) the containing space is a closed space which has a single opening comprising the through opening of the closing part, c) the container only has said outflow part of said neck of the second containing element for the entry and outflow of the liquid food substances, d) and said closing part of said cavity has a substantially flat shape; and the second containing element has one or more recessed elements or one or more raised elements for the outflow of the air contained in said cavity of the first body of the first containing element when the second containing element is introduced into said cavity, and said one or more recessed elements or one or more raised elements extend throughout an entire height of at least one of the side walls of the first part of said second containing element.

2. The container according to claim 1, wherein said first part of the second containing element is substantially identically sized as said containing space, delimited by said first body and said closing part, and suitable to house said first part of the second containing element, or said sizes of the first part of said second coupling element are smaller by a percentage value S, with 1% ⇐S⇐5%, than the corresponding sizes of the cavity of the first body of the first containing element.

3. The container according to claim 1, wherein the first containing element is only formed of a lower wall and an upper wall which are substantially flat and one or more side walls which are substantially perpendicular to said upper and lower walls;

the second containing element comprises a lower wall and an upper wall which are substantially flat, and one or more side walls which are substantially perpendicular to said lower and upper walls, and said lower walls, said upper walls and said side walls of the two containing elements are parallel to each other and also at least partially in contact with each other.

4. The container according to claim 1, wherein the first body of the first containing element is only formed of a first part suitable to delimit one or more side walls a second part suitable to delimit a bottom wall, in said two parts comprise portions for connecting the two parts which are at least partially plastically deformed, so as to form said first body.

5. The container according to claim 1, wherein the second containing element made of a plastic material for foodstuff which is substantially rigid and has a wall thickness of between 0.3 mm and 0.8 mm.

6. The container according to claim 1, wherein the first containing element has a lower wall that in correspondence with its edge has a folded portion having a U-shaped cross-section, so that a lower edge of the side wall may be introduced into the space delimited by the arms of said U-shaped folded portion, and said folded portion may be deformed so as to steadily constrain the side wall to the bottom wall.

7. The container according to claim 1, wherein the first containing element has a lower wall that has a step in correspondence with its edge, so as to create an innermost surface suitable to come into contact with a bottom wall of the second containing element and a peripheral surface at a larger distance from said bottom wall, hence creating peripherally an empty space which makes air outflow easier when the second containing element is introduced into the cavity of the first body of the first containing element, thus helping this introduction as well.

8. The container according to claim 1, wherein the upper closing part in correspondence with its edge has a folded portion having a U-shaped cross-section, so that the upper edge of the side wall may be introduced into the space delimited by the arms of said U-shaped folded portion, and said folded portion may be deformed so as to steadily constrain the side wall to the upper part.

9. The container according to claim 1, wherein the upper closing part has a step, so as to create an innermost surface suitable to come into contact with the upper wall of the second containing element and a peripheral surface at a larger distance from said upper wall, hence creating peripherally a larger-sized empty space which makes air outflow easier.

10. The container according to claim 1, wherein the in correspondence with the through opening the upper part of the first containing element has a folded edge suitable to strengthen and stiffen a perimeter of said opening.

11. The container according to claim 1, wherein the neck of the second containing element is out of axis compared to a central symmetry axis of the second containing element, and the axis of the neck is close to one of the smaller side walls of the containing element.

12. The container according to claim 1, wherein the neck has an outflow part projecting outside the first containing element, and is sized so as to project by a stretch from the upper free edge of the upper bottom wall of the first containing element, and said projecting stretch having a length of between 0.5 cm and 4 cm.

13. The container according to claim 1, wherein the first body of the first containing element is only formed of a first part suitable to delimit one or more side walls and a second part suitable to delimit a bottom wall, and said two parts comprise portions for connecting the two parts which are at least partially plastically deformed, so as to form said first body.

14. The container according to claim 1, wherein the through opening of the closing part has a size which is slightly higher than that of the outflow part of said the neck of the second coupling element, and a diameter of said outflow part of the neck is smaller than the diameter of the opening by a value of between 0.5 mm and 5 mm.

15. The container according to claim 1, wherein:

the sizes of the first part of the second coupling element are substantially the same than corresponding sizes of the cavity of the first body of the first containing element, or said sizes of the first part of said second coupling element are smaller by a percentage value S, with $1\% \Leftarrow S \Leftarrow 5\%$, than the corresponding sizes of the cavity of the first body of the first containing element.

16. A container for a liquid food substance comprising:

a first containing element made of a metal material comprising: at least one first body suitable to delimit a cavity, and a closing part for closing said cavity, suitable to be connected to said first body and comprising a through opening, wherein said first body and said closing part are both made of a metal material, and said first body and said closing part delimit a containing space;

a second containing element made of plastic material for foodstuff, comprising: a first part suitable to be introduced and completely housed in said first containing element, in said containing space and said cavity, and a neck departing from an upper wall of said first part of the second containing element suitable to cross the through opening of the closing part of the first containing element, and provided with an outflow part projecting outside said closing part of the first containing element suitable to allow the food substance to flow out of the container; said outflow part having means for removably connecting a cap for tightly sealing the container;

wherein both the first and the second containing element are substantially rigid and non-deformable elements having the same three-dimensional shape;

and;

a) above the closing part and projecting from said closing part, the container only has said closing cap and said outflow part of said neck of the second containing element so that the cap is always visible, b) the containing space is a closed space which has a single opening comprising the through opening of the closing part, c) the container only has said outflow part of said neck of the second containing element for the entry and outflow of the liquid food substances, d) and said closing part of said cavity has a substantially flat shape; and the second containing element has one or more recessed elements for the outflow of the air contained in the cavity of the first body of the first containing element, when the second containing element is introduced thereinto, and said recessed element extends throughout the entire height of at least one of the side walls of the first part of this second containing element.

17. A container for a liquid food substance comprising:

a first containing element made of a metal material comprising: at least one first body suitable to delimit a cavity, and a closing part for closing said cavity, suitable to be connected to said first body and comprising a through opening, wherein said first body and said closing part are both made of a metal material, and said first body and said closing part delimit a containing space;

a second containing element made of plastic material for foodstuff, comprising: a first part suitable to be introduced and completely housed in said first containing element, in said containing space and said cavity, and a neck departing from an upper wall of said first part of the second containing element suitable to cross the through opening of the closing part of the first containing element, and provided with an outflow part projecting outside said closing part of the first containing element, suitable to allow the food substance to flow out of the container; said outflow part having means for removably connecting a cap for tightly sealing the container;

wherein both the first and the second containing element are substantially rigid and non-deformable elements having the same three-dimensional shape;

and;

a) above the closing part and projecting from said closing part, the container only has said closing cap and said outflow part of said neck of the second containing element so that the cap is always visible, b) the containing space is a closed space which has a single opening comprising the through opening of the closing part, c) the container only has said outflow part of said neck of the second containing element for the entry and outflow of the liquid food substances, d) and said closing part of said cavity has a substantially flat shape; and a) above the closing part and projecting from said closing part, the container only has said closing cap and said outflow part of said neck of the second containing element, so that the cap is always visible, b) the containing space is a closed space which has a single opening comprising the through opening of the closing part, c) the container only has said outflow part of said neck of the second containing element for the entry and outflow of the liquid food substances, and d) said closing part of said cavity has a substantially flat shape.

* * * * *